US009863029B2

(12) United States Patent
Moon et al.

(10) Patent No.: US 9,863,029 B2
(45) Date of Patent: Jan. 9, 2018

(54) APPARATUS FOR FORMING NITROGEN CLOUD TO PRODUCE HOT DIP COATED STEEL SHEET

(71) Applicant: Dongkuk Steel Mill Co., Ltd., Seoul (KR)

(72) Inventors: Byung-Sun Moon, Busan (KR); Byung-Moon Lim, Busan (KR); Young-Keun Song, Busan (KR)

( * ) Notice: Subject to any disclaimer, the term of this patent is extended or adjusted under 35 U.S.C. 154(b) by 0 days.

(21) Appl. No.: 14/940,689

(22) Filed: Nov. 13, 2015

(65) Prior Publication Data

US 2016/0076127 A1 Mar. 17, 2016

Related U.S. Application Data

(60) Continuation-in-part of application No. 14/594,291, filed on Jan. 12, 2015, now abandoned, which is a (Continued)

(30) Foreign Application Priority Data

Aug. 1, 2012 (KR) ..... 10-2012-0084357
Jun. 11, 2013 (KR) ..... 10-2013-0066466

(51) Int. Cl.
*C23C 2/00* (2006.01)
*B05D 3/04* (2006.01)

(Continued)

(52) U.S. Cl.
CPC ..... *C23C 2/16* (2013.01); *B05D 3/042* (2013.01); *C23C 2/003* (2013.01); *C23C 2/06* (2013.01);

(Continued)

(58) Field of Classification Search
CPC .... C23C 2/04; C23C 2/00; C23C 2/20; C23C 2/16; C23C 2/14; C23C 2/18;

(Continued)

(56) References Cited

U.S. PATENT DOCUMENTS 1,981,699 A * 11/1934 Hill ..... C23C 2/003 266/275
2,294,490 A * 9/1942 Trautman ..... C23C 2/003 219/421

(Continued)

FOREIGN PATENT DOCUMENTS

JP S55-141554 A 11/1980
JP 2002-348651 A 12/2002

(Continued)

OTHER PUBLICATIONS

Letter from Australian Government, IP Australia dated May 6, 2016 regarding Notice of Acceptance of Application No. 201507962 for Applicant Dongkuk Steel Mill Co., Ltd.

(Continued)

*Primary Examiner* — Karl Kurple
(74) *Attorney, Agent, or Firm* — Lee & Associates, LLC

(57) ABSTRACT

A device installed between a surface of a coating bath and an air knife equipment to produce a hot dip metal coated steel sheet to form a non-oxidation atmosphere in a surface of a coated steel sheet ascending from the coating bath, the device comprising: lower gas discharge bars spaced apart from the surface of the coating bath by a predetermined distance and discharging a non-oxidation gas in a direction of the surface of the coating bath along the surface of the coated steel sheet; a side cover extending upwardly slopingly in a direction of the coated steel sheet from the sides of the lower gas discharge bars; and upper gas discharge bars (Continued)

formed at an upper end of the side cover and discharging a non-oxidation gas downwardly.

5 Claims, 6 Drawing Sheets

Related U.S. Application Data division of application No. 13/950,318, filed on Jul. 25, 2013, now abandoned.

(51) Int. Cl.

| | |
|---|---|
| ***C23C 2/16*** | (2006.01) |
| ***C23C 2/26*** | (2006.01) |
| ***C23C 2/06*** | (2006.01) |
| ***C23C 2/12*** | (2006.01) |
| ***C23C 2/30*** | (2006.01) |
| *B05C 3/12* | (2006.01) |
| *B05D 1/18* | (2006.01) |
| *B05C 11/11* | (2006.01) |

(52) U.S. Cl.
CPC ..... *C23C 2/12* (2013.01); *C23C 2/26* (2013.01); *C23C 2/30* (2013.01); *B05C 3/125* (2013.01); *B05C 11/11* (2013.01); *B05D 1/18* (2013.01)

(58) Field of Classification Search
CPC ..... C23C 2/003; C23C 2/30; B05C 11/06; G05D 5/02; B65G 49/02; B65G 49/04
USPC ..... 427/432
See application file for complete search history.

(56) References Cited

U.S. PATENT DOCUMENTS

| | | | | | |
|---|---|---|---|---|---|
| 2,802,656 | A * | 8/1957 | Martiny | C23C 2/30 | 266/200 |
| 2,926,103 | A * | 2/1960 | Brick | C23C 2/12 | 118/114 |
| 3,607,366 | A * | 9/1971 | Kurokawa | C23C 2/20 | 118/63 |
| 3,635,748 | A * | 1/1972 | Peoples | C23C 2/38 | 118/47 |
| 3,897,202 | A * | 7/1975 | Ackermann | C03B 5/2356 | 126/343.5 A |
| 4,103,644 | A * | 8/1978 | Michels | C23C 2/006 | 118/223 |
| 4,172,911 | A * | 10/1979 | Michels | C23C 2/006 | 118/223 |
| 4,296,145 | A * | 10/1981 | Higuchi | B05C 9/02 | 118/410 |
| 4,330,574 | A * | 5/1982 | Pierson | C23C 2/40 | 427/319 |
| 4,444,814 | A * | 4/1984 | Flinchum | C23C 2/40 | 118/419 |
| 4,478,892 | A * | 10/1984 | Amberson | C23C 2/02 | 118/419 |
| 4,502,408 | A * | 3/1985 | Hennechart | C23C 2/265 | 118/308 |
| 4,552,788 | A * | 11/1985 | Sato | C23C 2/36 | 427/374.5 |
| 4,557,952 | A * | 12/1985 | Mitch | C23C 2/36 | 427/432 |
| 4,612,215 | A * | 9/1986 | Hennechart | C23C 2/265 | 118/308 |
| 4,719,129 | A * | 1/1988 | Caudill | B05B 13/0207 | 118/63 |
| 5,544,869 | A * | 8/1996 | Chifo | C23C 2/36 | 118/405 |
| 6,579,615 | B1 * | 6/2003 | Sugimaru | C23C 2/02 | 148/533 |
| 7,914,851 | B2 * | 3/2011 | Kim | C23C 2/06 | 427/331 |
| 8,062,711 | B2 * | 11/2011 | Lofgren | C23C 2/003 | 118/400 |
| 8,113,139 | B2 * | 2/2012 | Kim | C23C 2/20 | 118/62 |
| 8,752,502 | B2 * | 6/2014 | Eriksson | C23C 2/003 | 118/419 |
| 2006/0110143 | A1 * | 5/2006 | Ito | H01L 21/67051 | 392/388 |
| 2008/0142125 | A1 * | 6/2008 | Meurer | C23C 2/06 | 148/533 |
| 2010/0200126 | A1 * | 8/2010 | Onozawa | C21D 1/40 | 148/533 |
| 2011/0177253 | A1 * | 7/2011 | Oohashi | C23C 2/06 | 427/432 |
| 2012/0135271 | A1 * | 5/2012 | Ooi | B32B 15/013 | 428/653 |
| 2012/0282488 | A1 | 11/2012 | Fujii et al. | | |
| 2013/0232811 | A1 * | 9/2013 | Koga | C23C 2/20 | 34/241 |
| 2013/0327806 | A1 * | 12/2013 | Jang | C23C 2/003 | 226/196.1 |
| 2014/0109793 | A1 * | 4/2014 | Yamauchi | C23C 2/003 | 106/1.05 |
| 2014/0366802 | A1 * | 12/2014 | Itoh | C23C 2/003 | 118/712 |
| 2015/0140225 | A1 * | 5/2015 | Gusek | C23C 2/00 | 427/432 |
| 2016/0122854 | A1 * | 5/2016 | Schwander | C23C 2/003 | 118/712 |

FOREIGN PATENT DOCUMENTS

| | | | |
|---|---|---|---|
| JP | 2010-202951 | A | 9/2010 |
| WO | 2011102434 | A1 | 8/2011 |
| WO | WO2011/102434 | A1 | 8/2011 |

OTHER PUBLICATIONS

Letter from Australian Government, IP Australia dated Apr. 8, 2016 regarding the Patent Examination Report No. 1 for Patent Application No. 2015207962 for Applicant Dongkuk Steel Mill Co., Ltd.
Letter from Patent and Trademark Attorneys, dated May 1, 2016 regarding Australian Patent No. 2015207962 for Applicant Dongkuk Steel Mill Co., Ltd.

* cited by examiner

Zn-4%Al-2%Mg-0.005%Ba Zn-5%Al-2%Mg-0.005%Ba

Zn-4%Al-2%Mg-0.005%Ba Zn-5%Al-2%Mg-0.005%Ba

APPARATUS FOR FORMING NITROGEN CLOUD TO PRODUCE HOT DIP COATED STEEL SHEET

This application is being filed as a continuation-in-part of Ser. No. 14/594,291, which was filed on Jan. 12, 2015.

BACKGROUND OF THE INVENTION

Field of the Invention

The present invention relates to an apparatus for producing a hot-dip metal coated steel sheet with superior workability and corrosion resistance.

Description of the Related Art

A hot-dip metal coated steel sheet is widely used in an attempt to secure corrosion resistance of a base steel sheet. Typically, a zinc-coated steel sheet (GI) is widely used based on economic efficiency and resource abundance, and is currently a type of the most generally used coated-steel sheet. In addition, a great deal of research to improve the corrosion resistance of zinc-coated steel sheets has been made. In particular, an aluminum-coated steel sheet (so-called "Galvalume") having an Al—Zn content of 55% was suggested in the late 1960s and exhibits superior corrosion resistance and a beautiful appearance at present.

Such an aluminum-coated steel sheet exhibits superior corrosion resistance and heat resistance, as compared to zinc-coated steel sheets and is thus widely applied to automobile mufflers, household appliances, heat-resistant materials and the like.

For example, Japanese Patent Publication No. 57-47861 discloses an aluminum steel sheet containing Ti in iron, Japanese Patent Publication No. 63-184043 discloses an aluminum-coated steel sheet containing C, Si, Cu, Ni and a small amount of Cr in iron, and Japanese Patent Publication No. 60-243258 discloses an aluminum-coated steel sheet containing 0.01 to 4.0% of manganese, 0.001 to 1.5% of titanium and 3.0 to 15.0% of silicon.

In addition, in order to inhibit growth of a Fe—Al alloy layer or rapid diffusion of aluminum metal into iron by reaction of aluminum with iron, 10% or less of Si is added to an aluminum coating bath. A coated steel sheet produced by this method exhibits relatively superior workability and heat resistance and is widely used for heat-resistant elements such as automobile mufflers, hot water suppliers, heaters, and electric rice cooker inner skins.

However, silicon added to inhibit formation of alloy layers may often cause damage to surface appearance of coated steel sheets and disadvantageously make the surface appearance unclear. In this regard, damage to surface appearance caused by silicon addition is known to be solvable to some extent through addition of a small amount of magnesium (U.S. Pat. No. 3,055,771 to Sprowl).

In addition, in recent years, extended lifespan of components used for automobile exhaust gas systems has brought about development of steel sheets obtained by introducing Cr to an aluminum-coated steel sheet. For example, Japanese Patent Publication No. 63-18043 discloses a coated steel sheet containing 1.8 to 3.0% of chromium and Japanese Patent Publication No. 63-47456 discloses a steel sheet containing 2 to 3% of chromium.

Meanwhile, a Zn—Al alloy-coated steel sheet has a disadvantage in that a processed shear portion does not exert sufficient corrosion resistance. This phenomenon is caused by deterioration in corrosion resistance of a surface exposed to the shear portion which results from a decrease in sacrificial corrosion-resistant zinc preventing corrosion of iron through the zinc-aluminum alloy layer. In addition, a Zn—Al alloy-coated steel sheet has a disadvantage of deterioration in corrosion resistance after processing since a coating layer having no heterogeneous alloy phase is formed and an interface surface is vulnerable upon use after a bending or drawing processing and corrosion resistance is thus deteriorated after the processing.

In order to solve these phenomena, Korean Patent No. 0586437 discloses coating a Zn—Al—Mg—Si alloy-coated steel sheet material with superior corrosion resistance in a coating bath containing 45 to 70% by weight of Al, 3 to 10% by weight of Mg, 3 to 10% by weight of Si, and the balance of Zn and inevitable impurities, and Korean Patent No. 0928804 discloses a Zn—Al—Mg alloy-coated steel sheet with superior corrosion resistance and workability.

Surface quality of a hot-dip metal coated steel sheet may be relied on a technique of controlling a surface of a steel plate from a plating bath, as well as a composition of the coating bath. Components of a hot dip coating layer, for example, zinc (Zn), aluminum (Al), and magnesium (Mg) are bonded with oxygen in the air to form an oxide film which degrades surface quality of coated steel sheet. In particular, a coated steel sheet product obtained by adding magnesium (Mg) to a coating bath has a problem with outer appearance quality of a surface compared with a case of general GI or GL coating bath in many cases, and the problem is caused due to oxidation as characteristics of the Mg element. Mg is an element having a high oxidation, and oxidation reactivity of Mg is particularly increased in a coating bath having a high temperature, and due to this, an oxide or fine Mg oxidation material bonded with other elements is confined in a strip to degrade quality of the surface of the coated steel sheet.

In an effort to solve the problem, a related art method of forming a non-oxidation atmosphere for preventing oxidation in a section in which a strip deposited in a molten metal coming from a coating bath (port) is exposed and cooled in the air to perform coating, and an apparatus thereof have been well known.

Examples of the related arts include International Publication WO2011/102434 (D1), Japanese Laid-Open Patent Publication 55-141554 (D2), Japanese Laid-Open Patent Publication 2010-202951 (D3), Japanese Laid-Open Patent Publication 2002-348651 (D4), and the like.

However, existing methods and apparatuses for forming the non-oxidation atmosphere in the section in which the strip is deposited in a molten metal and subsequently exposed in the air have several problems.

That is, as illustrated in the drawings (see FIG. 2 of D1, FIG. 2 of D2, FIG. 2 of D3, and FIG. 3 of D4) of the aforementioned related arts, the related art apparatuses for forming the non-oxidation atmosphere are configured as a box type covering the entirety from a surface of the coating molten metal to an upper air knife device.

When the coated steel plate is manufactured, a temperature of each coating bath is about 460° C. (general zinc-aluminum coated steel sheet coating bath), about 600° C. (galvalume steel sheet coating bath), and about 650° C. (aluminum coated steel sheet coating bath), and here, due to the sealed box form, an internal heated air having a high temperature cannot be discharged properly in the air and increases an internal temperature of the box.

The related art method and structure causes many problems in an actual process as follows:

Deformation of a structure due to heat in the limited space

Structures such as Air Knife Rip, Rip, Sink roll Arm, or the like are thermally deformed.

Malfunctioning of an electric device for driving air knife, such as various sensors or a motor attached to the air knife In order to prevent this, a cooling device needs to be separately provided to prevent an increase in temperature of various electric devices. Further, lifespan of the various electric devices is also reduced.

It is not easy to control spangles after controlling coating and an attachment amount Micronizing a spangle size on a surface of the coated steel sheet significantly affect product quality, and in order to micronize spangles, cooling should be quickly performed after an attachment amount is controlled, but in the case of the box type, cooling efficiency is degraded due to internal latent heat. In order to increase a cooling speed of the strip after coating, various other techniques such as spraying mist or spraying metal powder, in addition to a cooling technique of spraying air, are actually used, but the box type structure is a structure or method which rather hinders cooling after coating.

It is not easy to remove top dross generated on an upper portion of a coating bath.

The purpose of forming a non-oxidation atmosphere by spraying a nitrogen gas is to suppress generation of oxidation hot-dip and adsorption of generated oxide to the strip, but the box type has a structure making it difficult to remove top dross generated on the surface of the molten metal.

A considerable amount of oxide is actually generated on a surface of the strip even under the non-oxidation atmosphere, which is to be removed periodically using personnel or a robot device but the box type structure having a sealed form needs to have an opening and closing type door and the opening and closing type door needs to be repeatedly opened and closed for an operation of removing the oxide from the surface of the strip. In this case, the repeated opening and closing causes difficulty in maintaining a stable nitrogen atmosphere within the box.

Increase in cost of nitrogen gas

There are two types of methods for filling the interior of the box type structure with nitrogen, that is, a method for filling the interior of the box type structure using nitrogen sprayed for controlling a coating attachment amount from an air knife and a method of supplying nitrogen through a different supply line from the outside.

A nitrogen amount sprayed from the air knife of an actual continuous zinc coating line is generally about 3000 to 6000 m3/hr, which is insufficient for filling oxygen within the box type structure with nitrogen, and as mentioned above, in order to outwardly discharge heat due to a temperature of molten metal, a nitrogen gas should be additionally supplied from the outside. To this end, nitrogen of about 3000 to 4000 m3/hr needs to be additionally supplied in addition to the nitrogen supplied from the air knife, which is twice or more of a general nitrogen usage amount and occupies a considerable portion of manufacturing cost.

SUMMARY OF THE INVENTION

Therefore, the present invention has been made in view of the above problems, and it is an object of the present invention to provide a device installed between a surface of a coating bath to produce a hot dip metal coated steel sheet and an air knife equipment to form a non-oxidation atmosphere on the circumference of a coated steep sheet ascending from the coating bath.

The device of the present invention includes lower gas discharge bars spaced apart from the surface of the coating bath by a predetermined distance and discharging a non-oxidation gas in a direction of the surface of the coating bath along the surface of the coated steel sheet; a side cover extending upwardly slopingly in a direction toward the coated steel sheet from the sides of the lower gas discharge bars; and upper gas discharge bars formed at an upper end of the side cover and discharging a non-oxidation gas downwardly.

The non-oxidation gas, which serves to prevent a surface of the steel sheet to from being bonded with oxygen in the air to form an oxide film, includes an inert gas or a gas having a very low reactivity. In an embodiment of the present invention, a nitrogen gas is typically used as an example of the gas.

The device for forming the non-oxidation atmosphere according to the present invention, which is a device for manufacturing a coated steel sheet having excellent corrosion resistance and surface appearance characteristics, while solving the aforementioned problem, is used to manufacture a molten metal zinc coated steel sheet, a molten metal zinc-aluminum coated steel sheet, a galvalume steel sheet, a molten metal aluminum coated steel sheet, and the like.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, the present invention will be described in more detail. In the present invention, an oxidation suppressing atmosphere is formed through installation of a nitrogen curtain at a lower end portion of an air knife (non-oxidation atmosphere device=nitrogen cloud (tent) forming device) of a coating bath, and a top dross floater is prevented from being adsorbed to a base steel sheet (strip). After the strip is deposited in the coating bath, a reaction of oxide generated when the strip ascends to an interface of the coating bath with oxygen is blocked to be minimized, and the generated oxide is prevented from accessing the strip to prevent surface adsorption. Also, in a case in which the strip is integrally formed with the air knife, a gap between a molten metal and the knife is minimized in controlling a coating attachment amount to facilitate controlling of a coating attachment amount, and due to a supplementary effect of reducing a temperature of a lower end portion by a predetermined portion, an effect of enhancing surface quality according to an increase in a cooling speed after coating may be realized.

Figure 1:
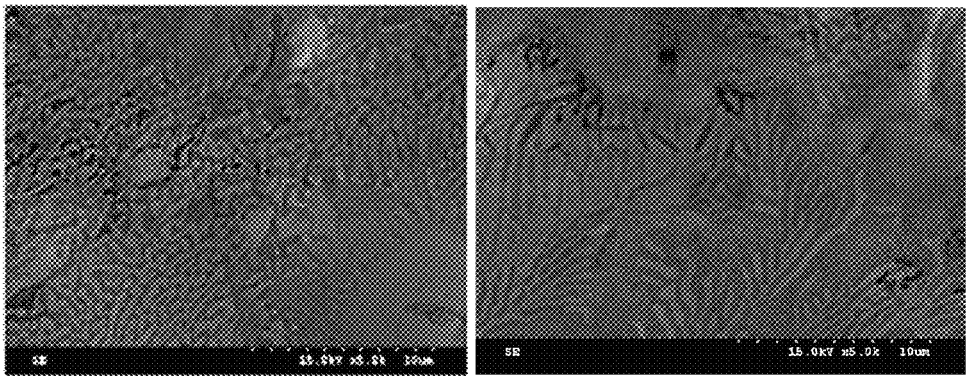
FIG. 1 is images (magnification of 5,000×) showing surface of GI coating bath-based Mg—Al—Ba added coated steel sheets generated by the device of the present invention.
Figure 2:
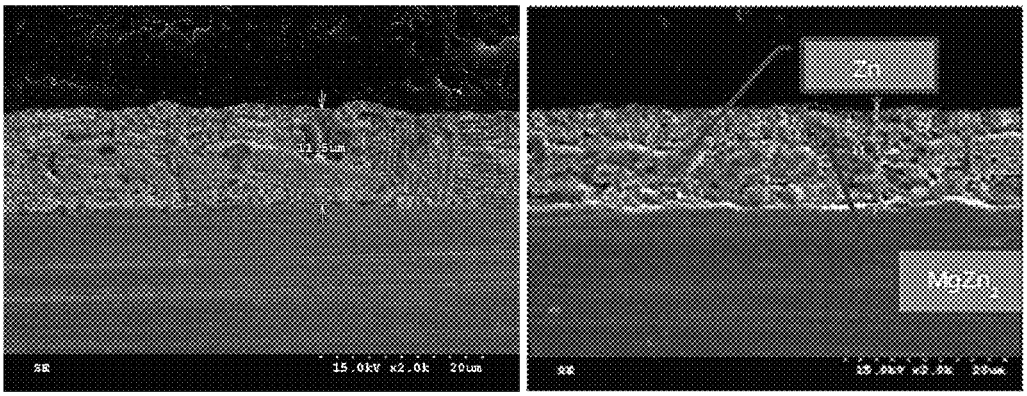
FIG. 2 is images (magnification of 2,000×) showing the cross-section of GI coating bath-based Mg—Al—Ba added coated steel sheets generated by the device of the present invention.
Figure 3:
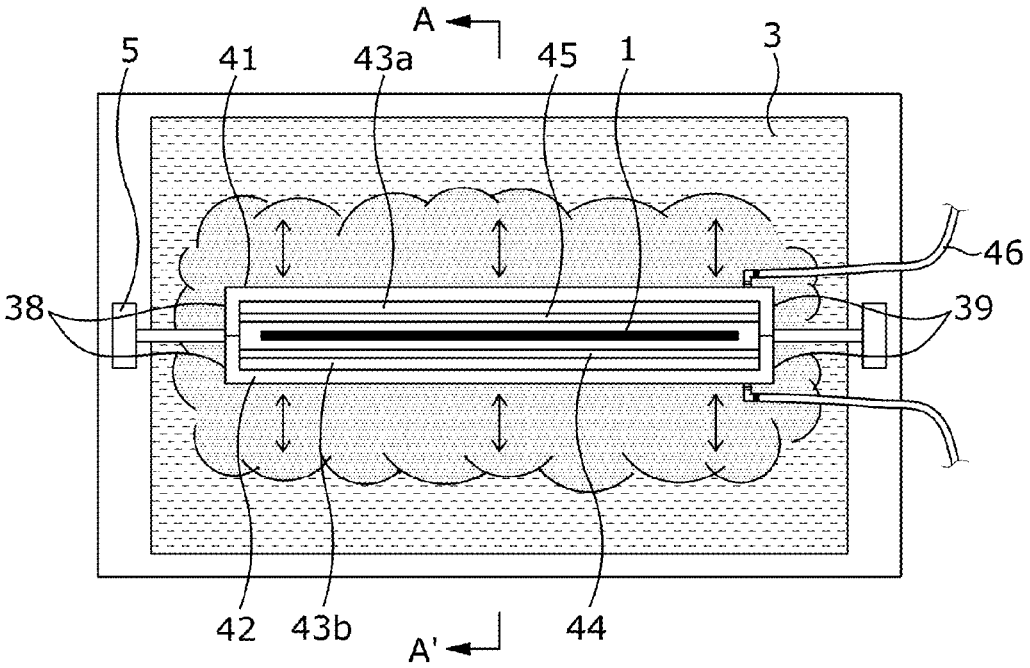
FIG. 3 is a plan schematic view illustrating a device for forming a nitrogen dam (device for forming a nitrogen cloud) according to an embodiment of the present invention.
Figure 4:
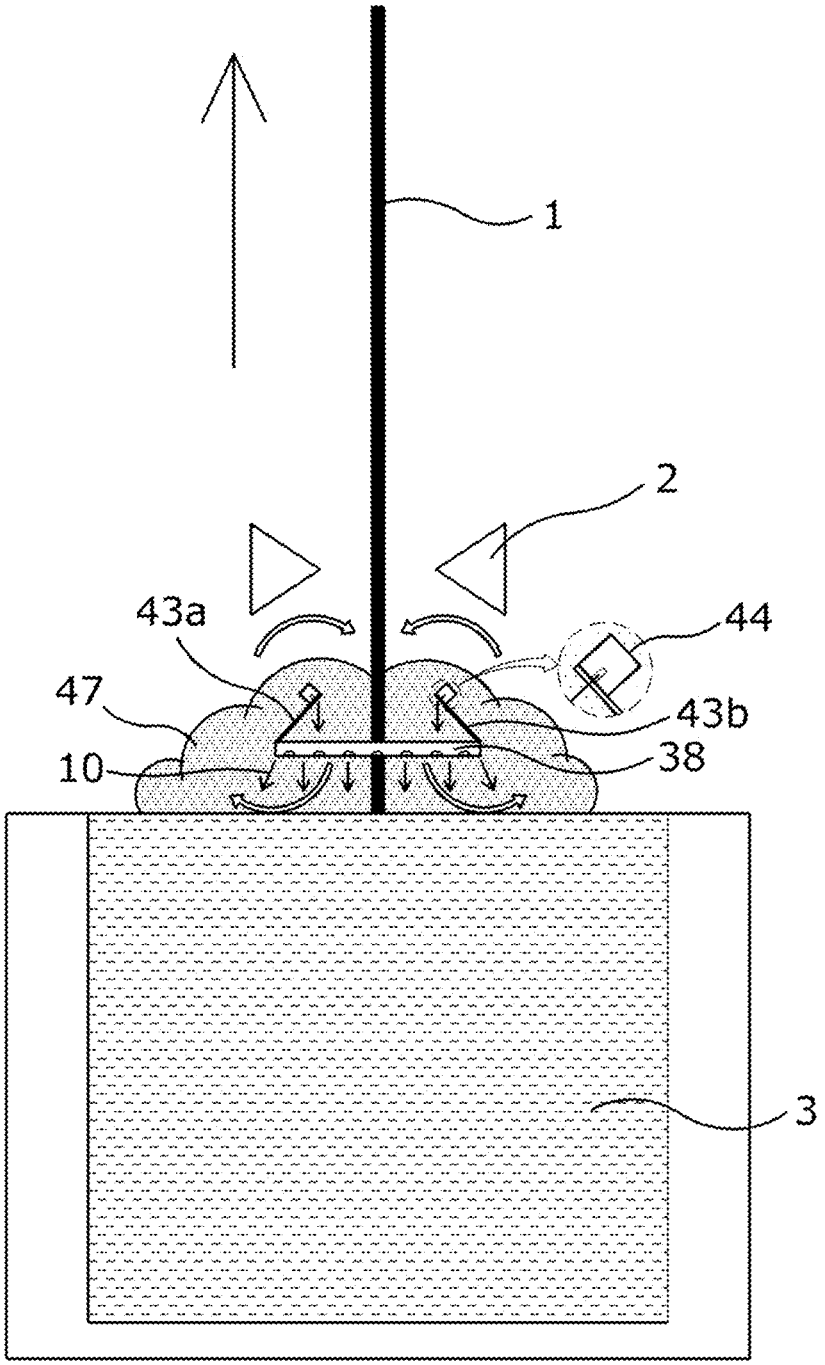
FIG. 4 is a sectional view taken along A-A' section of FIG. 3.
Figure 5:
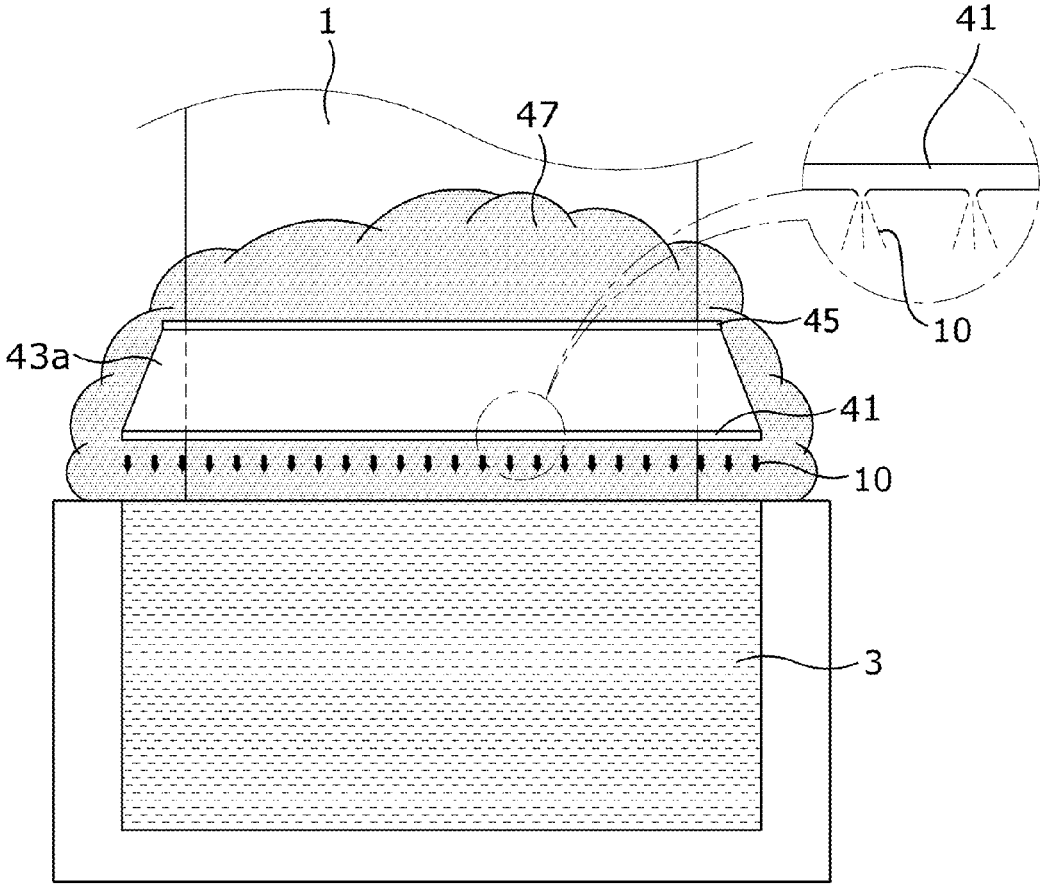
FIG. 5 is a schematic view of the device shown in FIG. 4.
Figure 6:
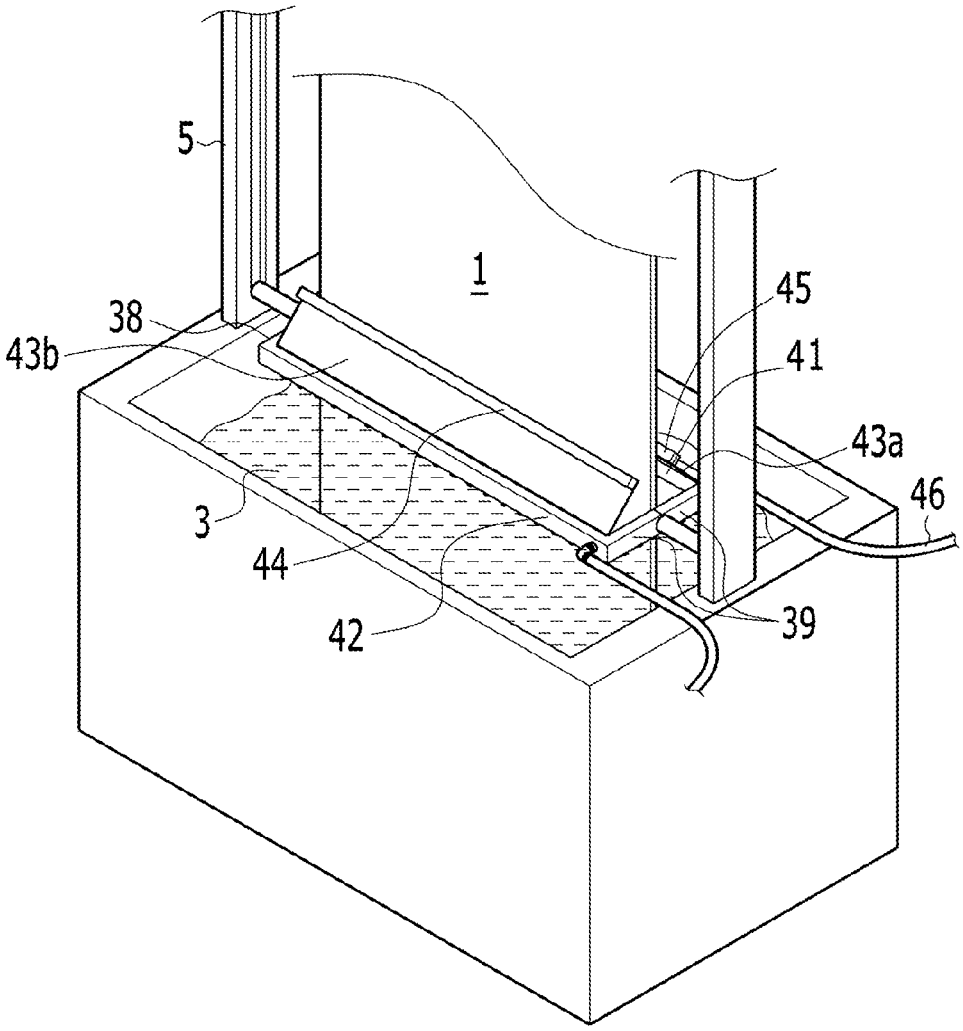
FIG. 6 is a perspective view of the device shown in FIG. 3.

FIGS. 3 to 6 schematically illustrate the device of the present invention. The device of the present invention is installed to be spaced apart from a surface of the coating bath 3 by a predetermined distance and vertically moved up and down between the surface of the coating bath 3 and an air knife 2 by a lifting unit 5.

The device of the present invention includes lower end nitrogen discharge bars 38, 39, 41 and 42 formed to have a rectangular shape surrounding four sides of the coated steel sheet 1 in a width direction and a thickness direction, ascending from a surface of the coating bath 3. The lower end nitrogen discharge bars 38, 39, 41 and 42 receive nitrogen from a nitrogen supply pipe 46 and discharge a nitrogen gas in a direction of the surface of the coating bath 3. Although not shown, a plurality of holes (nozzles) for erupting a nitrogen gas are formed at a predetermined interval on a lower surface of each of the lower end nitrogen discharge bars 38, 39, 41 and 42.

Although the lower end nitrogen discharge bars 38, 39, 41 and 42, which are pipes having a rectangular shape, may be integrally formed, as illustrated in the drawing, they may be separated as a first bar 41 and a second bar 42 and spaced apart from one another to be open in a thickness direction (in a vertical direction of the drawing) of the coated steel sheet 1).

Also, the device of the present invention includes side covers 43*a* and 43*b* extending upwardly slantingly in a direction of the coated steel sheet 1 from the upper ends of the lower end gas discharge bars 41 and 42 surrounding both sides of the coated steel sheet 1 in a width direction and having upper ends formed to be spaced apart from the surface of the coated steel sheet 1 by a predetermined distance, and upper nitrogen discharge bars 44 and 45 formed at the upper ends of the side covers 43*a* and 43*b* and discharging a non-oxidation gas in a direction of the surface of the coating bath 3.

The upper nitrogen discharge bars 44 and 45, having a pipe shape formed to have a nitrogen discharge hole (not shown) in a direction of the surface of the coating bath, erupt a nitrogen gas in a direction of the surface of the coating bath while facing each other at the upper ends of the side covers 43*a* and 43*b* with the coated steel sheet 1 interposed therebetween. The upper nitrogen discharge bars 44 and 45 receive nitrogen from the nitrogen supply pipe 46.

Meanwhile, the side covers 43*a* and 43*b* extend upwardly slantingly in a direction of the coated steel sheet 1 from the upper ends of the lower end gas discharge bars 41 and 42 surrounding both sides of the coated steel sheet 1 in a width direction and having upper ends formed to be spaced apart from the surface of the coated steel sheet 1 by a predetermined distance. Accordingly, the discharged nitrogen gas 10 may be seized to the vicinity of the coated steel plate 1, rather than being dispersed.

Advantages of the device for forming a nitrogen cloud of the present invention described above will be described compared with the related art apparatuses D1 to D4.

1) Since the device of the present invention forms the nitrogen cloud only in a partial space at a lower end of the air knife, the structure is not deformed due to latent heat generated by the related art box type and there is no factor hindering micronization of spangles due to a degradation of a cooling rate after coating.

The method and device of the present invention relate to a method (or structure) of forming nitrogen DAM by forming a nitrogen curtain (nitrogen cloud) using a nozzle in a section of a lower end portion of the air knife in which oxidation may first occur or in which a dross may adsorbed to the strip on the surface of the coating molten metal, rather than having such a box type as that in the cited inventions in which the entirety of an air knife for controlling a coating attachment amount from the surface of the coating molten metal is covered. Since the nitrogen cloud 47 is formed using the nitrogen nozzle at upper and lower portions of the section of the lower end portion of the air knife and the interior thereof is maintained under a nitrogen atmosphere, rather than the method of filling the closed space with nitrogen, a gas may be smoothly flow from the interior of the apparatus outwardly, and thus, latent heat is not maintained. As can be seen in the drawings, since the nitrogen cloud 47 of the present invention is formed only in the partial space of the lower end of the air knife, it does not affect any structure (component) other than the surface of the coated molten metal or the strip on which coating is performed. Thus, a possibility of deforming the structure due to heat generated by the related art box type or generating an error due to heat of an electric device for driving the air knife such as various sensors or a motor is low.

2) The top dross may be easily removed

Since the manufacturing apparatus of the present invention is spaced apart from the surface of the coating molten metal by a predetermined distance, rather than an atmosphere of being directly in contact with the surface of the coating molten metal or deposited, dross may be removed by personnel or a robot through the space without being interfered. Also, since the cloud in the form of a nitrogen curtain sprayed through the nozzle is constantly maintained even when the apparatus or a tool is inserted into the separated space to remove the top dross, it may also be effective in maintaining the nitrogen atmosphere.

3) Effect of preventing adsorption of top dross of the upper portion of the coated molten metal to strip Even though the port portion of the coated molten metal is filled with nitrogen in manufacturing an Mg-added alloy coated steel sheet, it is not possible to actually perfectly prevent a fine oxide film by the partial top dross and Mg having high oxidation. However, since the amount can be considerably reduced, the manufacturing method of spraying the nitrogen gas is applied.

In the present invention, in order to suppress a fine oxide film at the upper portion of the coated molten metal and the top dross, the nitrogen atmosphere is formed and adsorption of the top dross and fine oxide film to the strip may also be physically prevented.

In the present invention, when a nitrogen is sprayed downwardly from the lower nitrogen discharge bars 41 and 42, a nitrogen cloud is formed in a side direction of the coating port (see FIGS. 3 to 6). This generates an effect of physically preventing movement of the top dross and fine oxide film floating in an upper portion of the coating bath to the vicinity of the strip to thus prevent adsorption thereof to the strip.

Thus, the method of the present invention obtaining the effect of preventing adsorption to the strip after coating simultaneously when the nitrogen atmosphere is formed is different from the related art device for suppressing an oxide by forming only the nitrogen atmosphere.

4) Reduction in cost for nitrogen gas

Since the device of the present invention forms the nitrogen atmosphere only at the required partial space at the lower end of the air knife, the nitrogen cloud may be maintained only with a small amount of nitrogen coming from the lower end nitrogen discharge bars 41 and 42, and is more effective compared with the box type for supplying nitrogen while maintaining a pressure higher than normal pressure.

Thus, the manufacturing method of the present invention is able to reduce a nitrogen usage amount, compared with the related art method for filling the interior of the box type with nitrogen. Also, the manufacturing method of the present invention is a manufacturing method which can exhibit a considerably effective oxide generation suppressing and adsorption preventing effect, compared with the related art method, even with the same amount of nitrogen.

Hereinafter, the present invention will be described in more detail through comparison between Examples and comparative Examples. These examples are provided only to illustrate the present invention in more detail and should not be construed as limiting the scope and spirit of the present invention.

A cold-rolled steel sheet with a thickness of 0.8 mm, a width of 120 mm and a length of 250 mm was coated using a melt-coating simulator. As shown in Table 1, a zinc-aluminum-based alloy-coated steel sheet was produced by changing a composition of the coating bath. In addition, a nitrogen cloud was formed using the nitrogen cloud formation device shown in FIGS. 3 to 6.

The amount of adhered coating was controlled using an air knife and the amount of coating of the produced zinc-aluminum-based alloy-coated steel sheet evaluated based on one side is shown in Table 1.

Evaluation items were corrosion resistance and workability. Corrosion resistance was compared with an initial rust generation time (5%) under a 35° C. NaCl salt spray test atmosphere in accordance with KSD 9504 and evaluated. Workability was compared and evaluated by observing a width (fracture width) of cracks generated after 180° OT bending test in accordance with a KSD 0006 test method using a 30 to 50× stereomicroscope and measuring the width of the fracture surface. Observation of alloy phase was carried out using an X-ray diffraction.

Detailed test results obtained by the test method are given below.

1. Dross level: an amount of dross generated in an upper part of coating bath after molten coating specimens according to coating composition.

◎: generation of 5% or less of dross with respect to coating bath

Δ: generation of 10 to 20% less of dross with respect to coating bath

X: generation of 20% or more of dross with respect to coating bath

2. Surface appearance: visibility (clearance) and formation level of spangles of surface appearance of coating layer observed by the naked eye ◎: Clear formation of spangles with high gloss Δ: Non-clear formation of spangles X: Little formation of spangles with bad appearance 3. Corrosion resistance of shear surface: ratio of rust generated after salt spray test for 1,000 hours ◎: rust ratio of 5% or less Δ: rust ratio of 10 to 20%

X: rust ratio of 30% or more

4. Corrosion resistance of flat portion: a ratio of rust generated after salt spray test for 2,500 hours.

◎: rust ratio of 5% or less

Δ: rust ratio of 20 to 30%

X: rust ratio of 30% or more

TABLE 1

| Items | | Coating bath composition (% by weight) Mg | Al | Ba (ppm) | Balance | $MgZn_2$ | AA | B | C | D | Appln. of nitrogen dam |
|---|---|---|---|---|---|---|---|---|---|---|---|
| Exams. of present invention | 1 | 1 | 3 | 10 | Zn and impurity | ◎ | Δ | Δ | ◎ | Δ | Applied |
| | 2 | 1 | 4 | 20 | | ◎ | ◎ | ◎ | ◎ | ◎ | |
| | 3 | 1 | 5 | 80 | | Δ | ◎ | Δ | ◎ | Δ | |
| | 4 | 2 | 3 | 10 | | ◎ | ◎ | ◎ | Δ | ◎ | |
| | 5 | 2 | 4 | 20 | | ◎ | ◎ | ◎ | ◎ | ◎ | |
| | 6 | 2 | 5 | 40 | | ◎ | ◎ | Δ | ◎ | ◎ | |
| | 7 | 3 | 3 | 20 | | ◎ | Δ | ◎ | ◎ | ◎ | |
| | 8 | 3 | 4 | 40 | | ◎ | ◎ | ◎ | ◎ | ◎ | |
| | 9 | 3 | 5 | 60 | | ◎ | ◎ | ◎ | ◎ | ◎ | |
| Comp. Exams. | 1 | 2 | — | — | | Δ | X | X | X | X | Not Applied |
| | 2 | 1 | 7 | 10 | | Δ | Δ | X | X | X | |
| | 3 | 3 | 7 | 10 | | Δ | X | Δ | Δ | Δ | |
| | 4 | 0.5 | 4 | 5 | | X | Δ | X | Δ | X | |
| | 5 | 4 | 4 | — | | Δ | X | X | Δ | X | |
| | 6 | 4 | 5 | 100 | | Δ | Δ | X | X | Δ | |

* A: Dross level, B: Surface appearance, C: Corrosion resistance of shear surface, D: Corrosion resistance of flat portion As illustrated in Table 1, it can be seen that the manufacturing example employing the device of the present invention has excellent surface appearance and corrosion resistance.

What is claimed is:

1. A device to form a non-oxidation atmosphere around the perimeter of a coated steel sheet (1) ascending from a coating bath (3), the device comprising:

lower gas discharge bars (38, 39, 41 and 42) spaced apart from the surface of the coating bath (3) by a predetermined distance and discharging a non-oxidative gas in a direction downwards toward the surface of the coating bath (3);

side covers (43*a* and 43*b*) extending upwardly from upper ends of the lower gas discharge bars (41 and 42), said side covers (43*a* and 43*b*) extending along a width direction of the coated steel sheet on opposite sides of the coated steel sheet (1), and having upper ends formed to be spaced apart from the coated steel sheet (1) by a predetermined distance, the side covers (43*a* and 43*b*) disposed slantingly in a direction traveled by the coated steel sheet when ascending from the coating bath; and upper gas discharge bars (44 and 45) formed at the upper ends of the side covers (43*a* and 43*b*) and discharging a non-oxidative gas in a direction downwards toward the surface of the coated bath (3), wherein the device is disposed between the surface of the coating bath (3) and air knife equipment (2) for adjusting a coating thickness of the coated steel sheet, wherein the lower gas discharge bars have four sides (38, 39, 41 and 42) which are configured to surround the coated steel sheet (1), wherein two sides (38 and 39) of the lower gas discharge bars face each other in a width direction of the coated steel sheet (1) and two other sides (41 and 42) of the lower gas discharge bars face each other in a thickness direction of the coated steel sheet (1).

2. The device according to claim 1, further comprising:

a non-oxidative gas supply pipe (46) supplying a non-oxidative gas to the lower gas discharge bars (38, 39, 41 and 42); and a plurality of holes (nozzles) formed on a lower surface of the lower gas discharge bars (38, 39, 41 and 42) for erupting the non-oxidative gas.

3. The device according to claim 1, further comprising a lifting unit (5) configured to move the device in a vertical direction between the surface of the coating bath (3) and the air knife equipment (2).

4. The device according to claim 2, further comprising a lifting unit (5) configured to move the device in a vertical direction between the surface of the coating bath (3) and the air knife equipment (2).

5. The device according to claim 1, wherein the upper gas discharge bars (44 and 45) has a cross-section having a rectangular shape.

* * * * *